US007987811B2

(12) United States Patent
Zhang et al.

(10) Patent No.: US 7,987,811 B2
(45) Date of Patent: Aug. 2, 2011

(54) APPARATUS FOR SUPPORTING WORKPIECES THEREON

(75) Inventors: Li-Hua Zhang, Shenzhen (CN); Ke Zhou, Shenzhen (CN); Jun-Zhen Feng, Shenzhen (CN); Shao-Jun Cai, Shenzhen (CN); Li-Ping Sun, Shenzhen (CN); Yue-Biao Zhang, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 874 days.

(21) Appl. No.: 11/964,841

(22) Filed: Dec. 27, 2007

(65) Prior Publication Data

US 2009/0072461 A1 Mar. 19, 2009

(30) Foreign Application Priority Data

Sep. 14, 2007 (CN) ..... 2007 1 0201706

(51) Int. Cl.
*B05C 13/00* (2006.01)

(52) U.S. Cl. ..... 118/500; 269/8; 269/289 R; 269/903; 248/309.4; 248/206.5

(58) Field of Classification Search ..... 118/500; 269/8, 289 R, 903; 248/309.4, 206.5; 425/11
See application file for complete search history.

(56) References Cited

U.S. PATENT DOCUMENTS

| | | | | |
|---|---|---|---|---|
| 6,572,091 | B2 | 6/2003 | Kimble | |
| 6,644,617 | B2 * | 11/2003 | Pitlor | 248/544 |
| 6,904,670 | B2 * | 6/2005 | Kawamura et al. | 29/748 |
| 2008/0210835 | A1 * | 9/2008 | Bagnall | 248/206.5 |

FOREIGN PATENT DOCUMENTS

TW I278261 4/2007

* cited by examiner

*Primary Examiner* — Laura Edwards
(74) *Attorney, Agent, or Firm* — Jeffrey T. Knapp

(57) ABSTRACT

An apparatus (100) for supporting workpieces thereon includes a seat (10), a holding board (20), and a magnetic module connecting the seat to the holding board. The magnetic module (70) includes a first member (40) secured in the seat and a second member (50) secured in the holding board. The first member and the second member cooperate to provide a magnetic force thereby detachably fixing the holding board to the seat.

9 Claims, 5 Drawing Sheets

APPARATUS FOR SUPPORTING WORKPIECES THEREON

BACKGROUND OF THE INVENTION

1. Field of the Invention

The present invention generally relates to apparatuses configured (i.e., structured and arranged) for supporting workpieces thereon and, particularly, to an apparatus configured for supporting workpieces thereon in pipelining.

2. Description of Related Art

With the development of wireless communication and information processing technologies, portable electronic devices, such as mobile telephones and electronic notebooks, are now in widespread use. These portable electronic devices enable consumers to enjoy high technology services, almost anytime and anywhere. Housings of such portable electronic devices are mass-produced in manufacturing. In order to improve efficiency, supporting apparatuses are used for carrying housings on a transmission strip in pipelining.

A typical supporting apparatus in pipelining for coating housings includes a positioning member and a hanging member mounted on the positioning member. The positioning member is fixed on a transmission strip. The housing waiting for coating is attached to the hanging member. After being coated, the housing may be removed from the supporting apparatus by a robot. However, the robot has to move at a same speed as that of the transmission strip in order to remove the coated housing, which increases difficulty in manufacturing.

Therefore, a new apparatus for supporting workpieces thereon is desired in order to overcome the above-described shortcomings.

SUMMARY

In one aspect thereof, an apparatus for supporting workpieces thereon includes a seat, a holding board, and a magnetic module connecting the seat and the holding board. The magnetic module includes a first member fixed in the seat and a second member fixed in the holding board. The first member and the second member cooperate to provide a magnetic force thereby detachably mounting the holding board to the seat.

Other advantages and novel features of the embodiments will become more apparent from the following detailed description thereof when taken in conjunction with the accompanying drawings.

BRIEF DESCRIPTION OF THE DRAWINGS

Many aspects of the present apparatus for supporting workpieces thereon can be better understood with reference to the following drawings. The components in the drawings are not necessarily drawn to scale, the emphasis instead being placed upon clearly illustrating the principles of the apparatus and its potential applications. Moreover, in the drawings, like reference numerals designate corresponding parts throughout the several views.

DETAILED DESCRIPTION OF THE EMBODIMENTS

Figure 1:
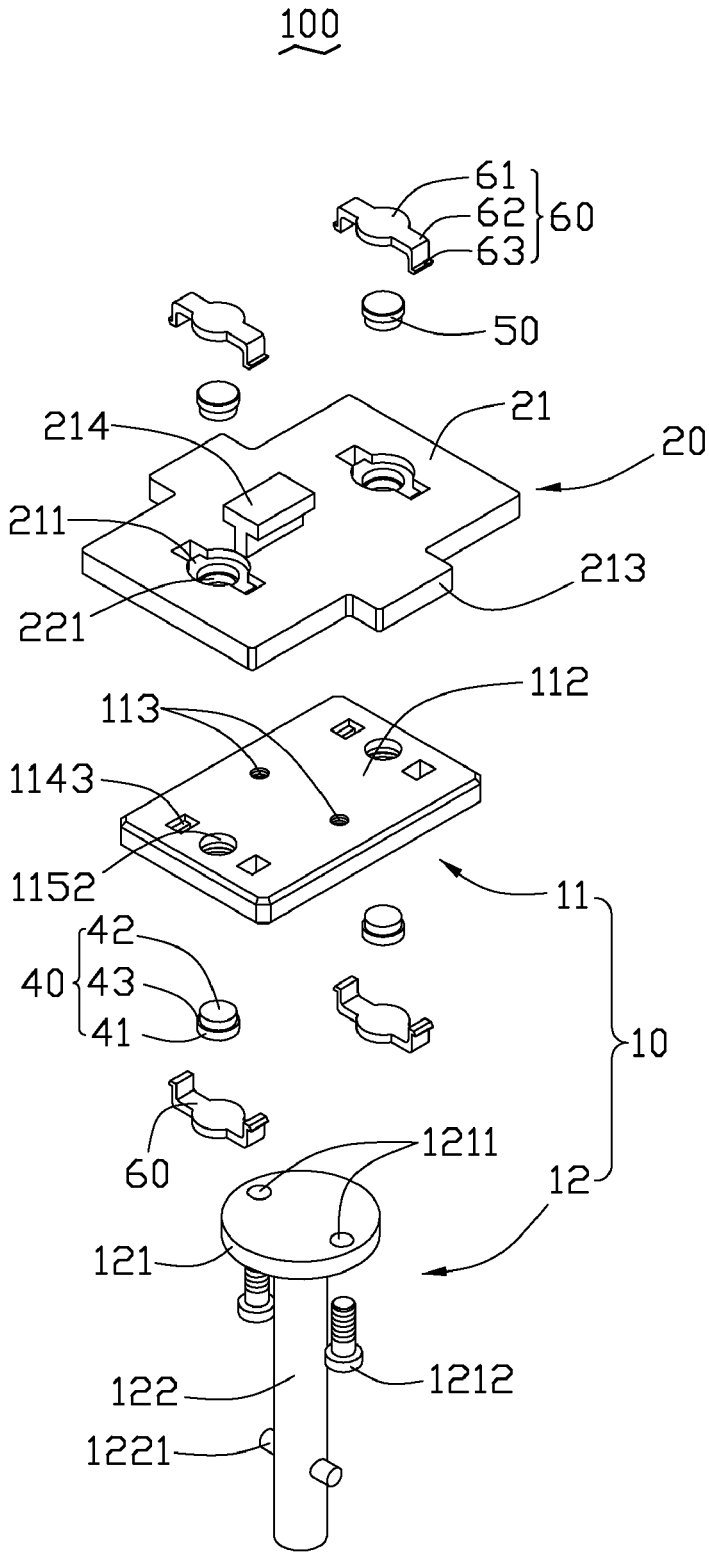
FIG. 1 is an exploded, isometric view of an apparatus in accordance with a present embodiment.
Figure 4:
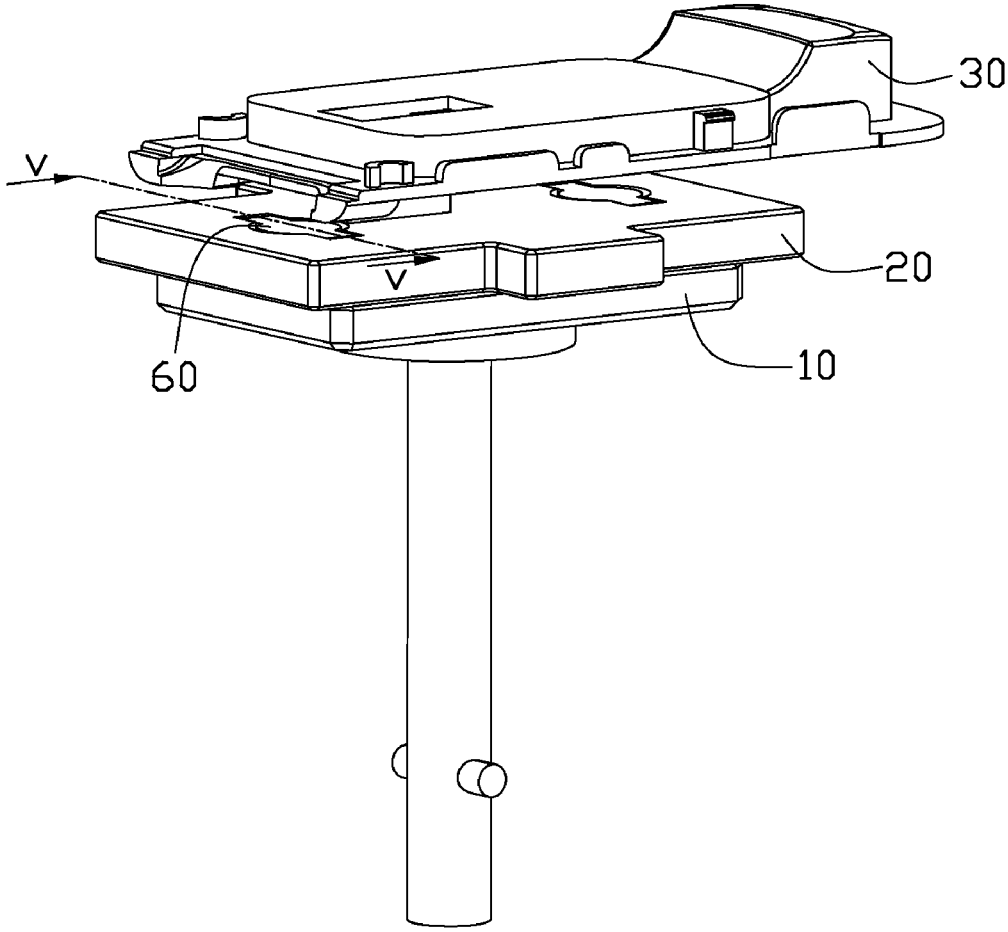
FIG. 4 is an assembled, isometric view of the apparatus shown in FIG. 1.

Referring to the drawings in detail, FIGS. 1, 4 and 7 show an apparatus 100 of a present embodiment, configured for supporting workpieces (not shown) such as housings of portable electronic devices thereon. The apparatus 100 includes a seat 10, a holding board 20, a hanging member 30 mounted to the holding board 20, a magnetic module 70 fixing the holding board 20 to the seat 10, and four covers 60 configured for securing the magnetic module 70 in the holding board 20 and the seat 10.

Figure 2:
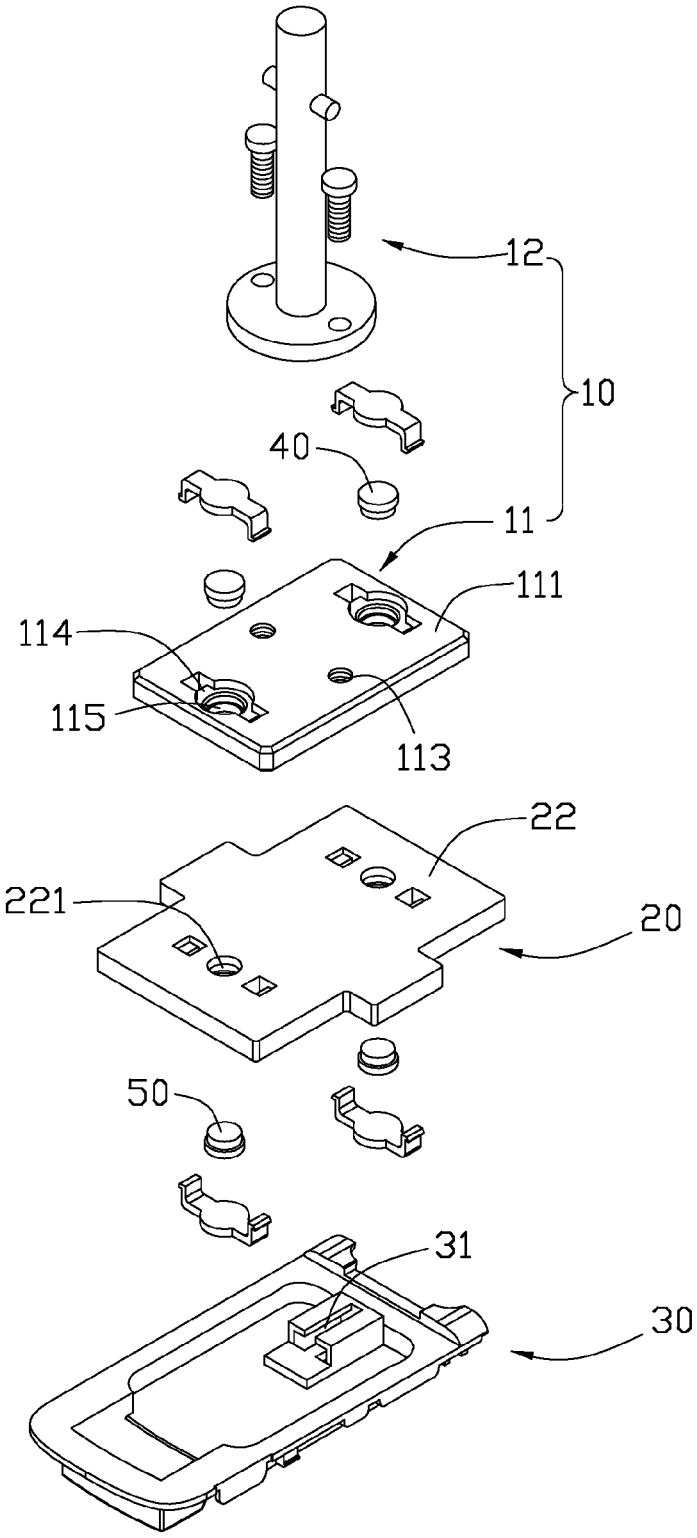
FIG. 2 is similar to FIG. 1, but viewed from another aspect.
Figure 3:
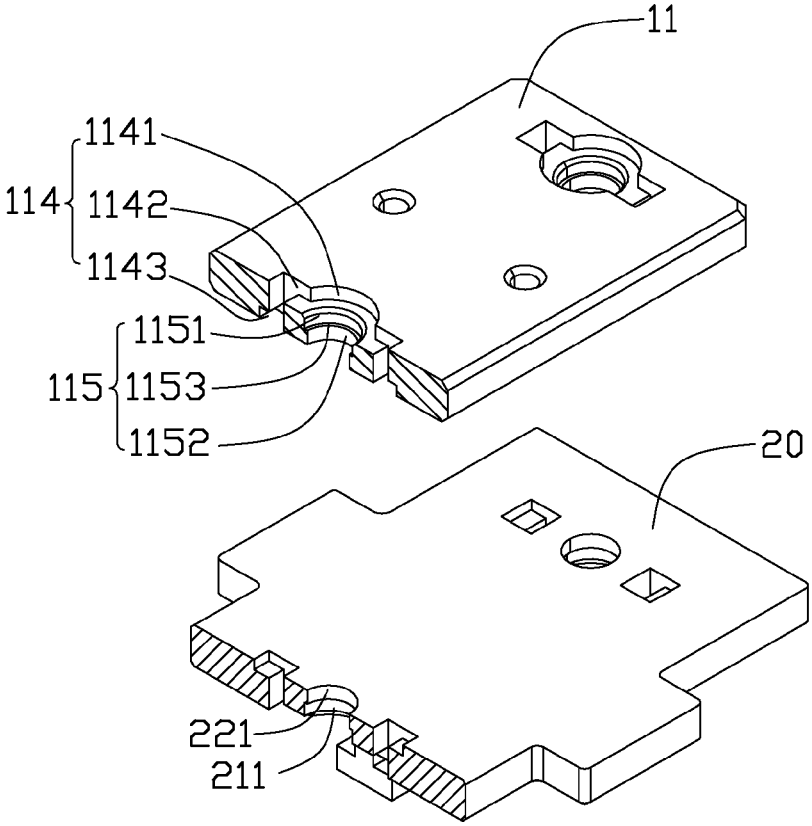
FIG. 3 is an enlarged, partially cut-away view of the supporting board and the holding board of the apparatus shown in FIG. 1.

Also referring to FIG. 2, the seat 10 includes a supporting board 11 and a positioning member 12 fixed to the supporting board 11. The supporting board 11 is a substantially rectangular board, and has a top surface 112 and a bottom surface 111 located at the opposite side of the top surface 112. The supporting board 11 defines two first receiving holes 114 therethrough and two first stepped recesses 115 in the top surface 112. Each first receiving hole 114 has a circular main hole 1141, two arm holes 1142 respectively extending from the main hole 1141 away from each other, and two finger holes 1143 respectively perpendicularly extending from a corresponding arm hole 1142 and away from the main hole 1141. Also referring to FIG. 3, each main hole 1141 communicates with a corresponding first stepped recess 115. Each arm hole 1142 is L-shaped. Each finger hole 1143 is defined in the top surface 112. Each stepped recess 115 has a cylindrical inner recess 1151 and a cylindrical outer recess 1152. The inner recess 1151 and the outer recess 1152 are coaxially arranged with each other and the inner recess 1151 has a larger diameter than that of the outer recess 1152. Each stepped recess 115 has a stepped surface 1153 formed between the inner recess 1151 and the outer recess 1152. The supporting board 11 has two screw holes 113 defined through the top surface 112 and the bottom surface 111.

The positioning member 12 includes a disk 121 and a column 122 extending perpendicularly from a center of the disk 121. The disk 121 defines two screw holes 1211 respectively corresponding to the two screw holes 113 of the supporting board 11. The supporting board 11 may be fixed to the disk 121 by inserting two bolts 1212 respectively in the screw holes 1211, 113. The column 122 is a substantially cylinder in shape and has a pin 1221 traveling through one end thereof along a diametral direction thereof.

The holding board 20 is a substantially rectangular board, and has a top surface 21 and a bottom surface 22 located at the opposite side of the top surface 21. The holding board 20 defines two second receiving holes 211 therethrough and two second stepped recesses 221 in the bottom surface 22. Each second receiving hole 211 is similar to each first receiving hole 114 of the supporting board 11. Each second stepped recess 221 is similar to each first stepped recess 115 of the supporting board 11. The holding board 20 has two protrusions 213 respectively extending outwardly from two opposite sides thereof and a latching projection 214 formed on the top surface 21. The latching projection 214 is substantially T-shaped. Further referring to FIG. 2, the hanging member 30 defining a T-shaped latching groove 31 configured for receiving the latching projection 214 therein thereby mounting the hanging member 30 to the holding board 20.

The magnetic module includes two first members 40 and two second members 50. Each first member 40 cooperates with a corresponding second member 50 to provide a magnetic force therebetween. One of the first member 40 and the second member 50 may be a permanent magnet or an electromagnet. The other of the first member 40 and the second member 50 may be a mass of metal such as iron, nickel, cobalt, or alloy thereof, a permanent magnet, or an electromagnet. Each first member 40 is a stepped cylinder in shape and has an inner end 41 and an outer end 42 coaxially connecting to the inner end 41 thereby forming a stepped surface 43. The inner end 41 has a larger diameter than that of the outer end 42. Each second member 50 is similar to each first member 40. Each first member 40 is configured for being receivable in a corresponding first stepped recess 115 of the supporting board 11. Each second member 50 is configured for being receivable in a corresponding second stepped recess 221 of the holding board 20.

The covers 60 may be made of liquid crystalline polymer (LCP). Each cover 60 has a circular cover body 61, two arms 62 extending outwardly from two opposite ends along a diameter of the cover body 61, and two fingers 63 respectively extending from distal ends of the two arms 62 and away from each other. Each arm 62 is substantially L-shaped. Each cover 60 is configured for being receivable in a corresponding first receiving hole 114 thereby securing a corresponding first member 40 in the supporting board 11 or in a corresponding second receiving hole 211 thereby securing a corresponding second member 50 in the holding board 20.

In assembly, each first member 40 is inserted into a corresponding stepped recess 115, the inner end 41 being received in the inner recess 1151 and the outer end 42 being received in the outer recess 1152. A corresponding cover 60 is inserted into the first receiving hole 114 corresponding to the first stepped recess 115, the cover body 61 being received in the main hole 1141, the two arms 62 being respectively received in the arm holes 1142, and the two fingers 63 being respectively received in the finger holes 1143. Thus, the first member 40 is fixed in the supporting board 11 with the outer end 41 exposed outwardly from supporting board 11. Each second member 50 is inserted into a corresponding second stepped hole 211 in a same way of each first member 40 as described above and a corresponding cover 60 is inserted into the second receiving hole 212 corresponding to the second stepped hole 211. Thus, the second member 50 is fixed in the holding board 20 with the outer end exposed outwardly from the holding board 20.

Figure 5:
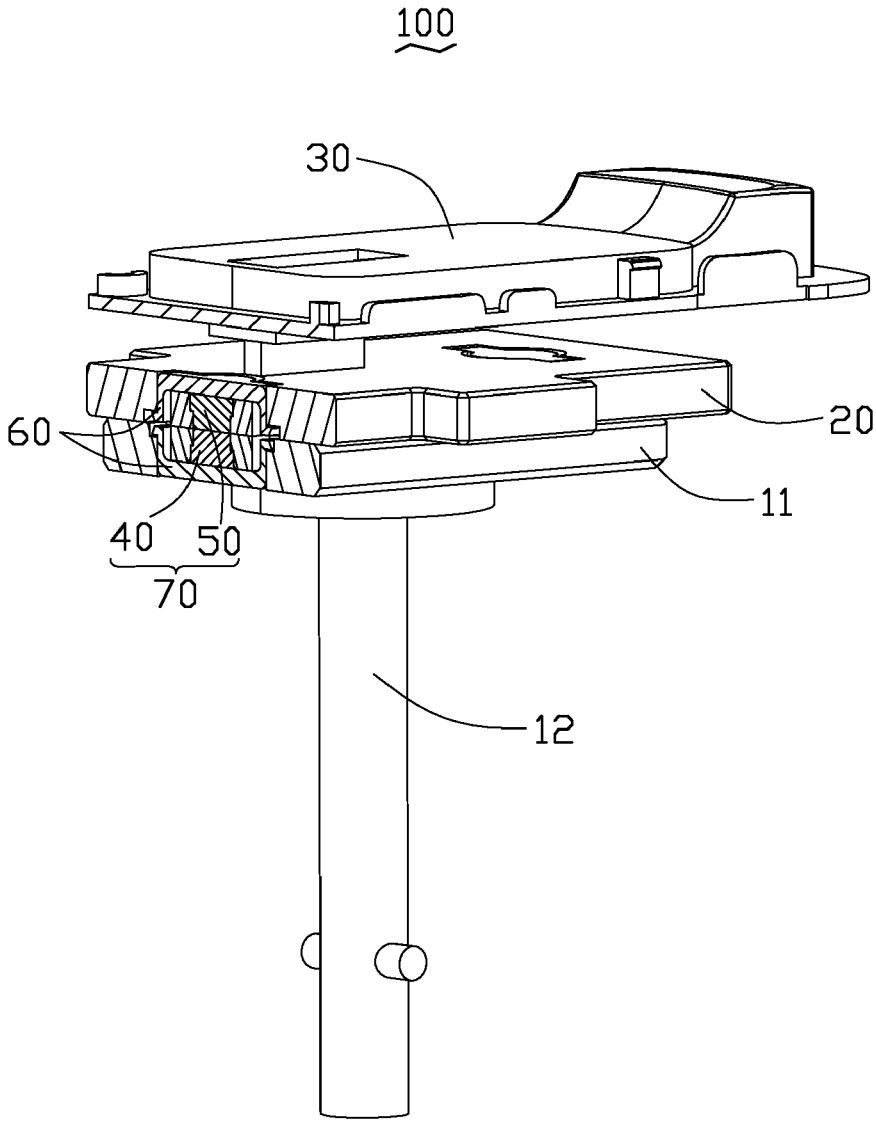
FIG. 5 is a partially cut-away view of the apparatus along line V-V of FIG. 4.

The supporting board 11 is placed on the disk 121 with the bottom surface 111 of the supporting board 11 in contact with the disk 121. Each screw hole 113 of the supporting board 11 corresponds with a screw hole 1211 of the disk 121. The supporting board 11 is secured on the disk 121 by inserting bolts 1212 into the screw holes 113, 1211. The holding board 20 is placed on the supporting board 11 with the bottom surface 22 of the holding board 20 in contact with the top surface 112 of the supporting board 11. Each first member 40 engages with a corresponding second member 50 to provide a magnetic force thereby mounting the holding board 20 to the supporting board 11. The hanging member 30 is mounted to the holding board 20 by inserting the latching projection 214 into the latching groove 31. Thus, the apparatus 100 is completely assembled as represented in FIGS. 4 and 5.

In use, the apparatus 100 is fixed to a transmission strip in pipelining. A workpiece such as a housing of a portable electronic device, is attached to the hanging member 30 for washing or coating. The holding board 20 with the housing may be removed away from the transmission strip by overcoming the magnetic force between the holding board 20 and the supporting board 11.

It is to be understood that the supporting board 11 and the holding board 20 may be made of plastic and the first members 40 and the second members 50 may be formed respectively in the supporting board 11 and the holding board 20 by insertion molding. The disk 121 may be omitted and the column 122 may be directly formed on the supporting board 11. The hanging member 30 may be omitted and the workpiece may be directly mounted to the holding board 20. Each member 40, 50 of the magnetic module 70 may be of alternative shape such as tapered, parallelepiped.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An apparatus for supporting workpieces thereon, comprising:

a seat;

a holding board having a latching projection formed at a surface thereof;

a magnetic module including a first member secured in the seat and a second member secured in the holding board, the first member and the second member cooperating to provide a magnetic force thereby detachably attaching the holding board to the seat; and a hanging member defining a latching groove therein, the latching groove receiving the latching projection, thereby fixing the hanging member to the holding board; wherein the workpieces are attached to the hanging member or the holding board to be supported.

2. The apparatus as claimed in claim 1, wherein the first member is a stepped cylinder in shape and has an outer end and an inner end coaxially arranged with each other, the seat defining a stepped recess therein configured for receiving the first member therein.

3. The apparatus as claimed in claim 2, further comprising a cover, wherein the cover is fixed to the seat thereby positioning the first member in the seat.

4. The apparatus as claimed in claim 3, wherein the cover has a circular cover body, two arms extending outwardly from two opposite ends along a diameter of the cover body, and two fingers respectively extending from the two arms, and the seat defining a receiving hole configured for receiving the cover therein.

5. The apparatus as claimed in claim 4, wherein each arm is L-shaped, each finger extending perpendicularly from a distal ends of a corresponding arm and away from the arm.

6. The apparatus of claim 5, wherein the receiving hole has a main hole configured for receiving the cover body of the cover therein, two arm holes configured for receiving the two arms therein, and two finger holes configured for receiving the two fingers therein, each arm hole communicates a corresponding finger hole with the main hole.

7. The apparatus of claim 1, wherein the seat includes a supporting board containing the first member therein and a positioning member extending perpendicularly from a center of the supporting board.

8. The apparatus of claim 7, wherein the positioning member includes a column mounted to the supporting board, the column having a pin formed at one end thereof.

9. The apparatus of claim 1, wherein the holding board has two protrusions respectively formed at two opposite sides thereof.

* * * * *